US010354828B1

(12) United States Patent
Moody et al.

(10) Patent No.: US 10,354,828 B1
(45) Date of Patent: Jul. 16, 2019

(54) PHOTOCATHODES WITH PROTECTIVE IN-SITU GRAPHENE GAS BARRIER FILMS AND METHOD OF MAKING THE SAME

(71) Applicant: Los Alamos National Security, LLC, Los Alamos, NM (US)

(72) Inventors: Nathan Moody, Los Alamos, NM (US); Jeffrey Pietryga, Los Alamos, NM (US); Gautam Gupta, Los Alamos, NM (US); Aditya Mohite, Los Alamos, NM (US); Vitaly Pavlenko, Los Alamos, NM (US); John Lewellen, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 0 days.

(21) Appl. No.: 15/644,711

(22) Filed: Jul. 7, 2017

Related U.S. Application Data

(60) Provisional application No. 62/360,295, filed on Jul. 8, 2016.

(51) Int. Cl.
*H01J 9/12* (2006.01)
*H01J 1/34* (2006.01)

(52) U.S. Cl.
CPC *H01J 1/34* (2013.01); *H01J 9/12* (2013.01); *H01J 2201/3421* (2013.01); *H01J 2209/012* (2013.01); *H01J 2209/02* (2013.01)

(58) Field of Classification Search
CPC ..... H01J 2209/02; H01J 9/12
USPC ..... 313/542
See application file for complete search history.

(56) References Cited

U.S. PATENT DOCUMENTS

| | | | | |
|---|---|---|---|---|
| 4,528,474 | A | 7/1985 | Kim | |
| 6,791,251 | B2 | 9/2004 | Seo et al. | |
| 6,800,990 | B2 | 10/2004 | Choi et al. | |
| 8,823,259 | B2 | 9/2014 | Moody | |
| 8,957,573 | B2 | 2/2015 | Vancil | |
| 8,981,338 | B2 | 3/2015 | Fuke et al. | |
| 9,102,524 | B2 | 8/2015 | Papadakis | |
| 9,790,620 | B1 | 10/2017 | Katsap | |
| 2004/0061429 | A1 | 4/2004 | Sakai et al. | |
| 2005/0067602 | A1 | 3/2005 | Schutz | |
| 2005/0174030 | A1 | 8/2005 | Katsap | |
| 2009/0291270 | A1* | 11/2009 | Zettl | B81C 99/008 428/195.1 |
| 2011/0048625 | A1* | 3/2011 | Caldwell | B82Y 30/00 156/233 |
| 2012/0295096 | A1* | 11/2012 | Liu | B82Y 30/00 428/312.8 |

(Continued)

OTHER PUBLICATIONS

U.S. Office action dated Nov. 1, 2018, for cross reference U.S. Appl. No. 15/644,704, (9 pages).

*Primary Examiner* — Christopher M Raabe
(74) *Attorney, Agent, or Firm* — Lewis Roca Rothgerber Christie LLP

(57) ABSTRACT

According to an embodiment of the present disclosure, a photocathode may include: a mesh having a first surface and a second surface facing away from the first surface, and including metallic, semiconductor or ceramic mesh grid with micron-sized openings in the mesh; a photosensitive film on the first surface of the mesh and extending at least partially into the openings of the mesh; and a graphene layer including one or more graphene sheets on the second surface of the mesh.

10 Claims, 17 Drawing Sheets

(56) References Cited

U.S. PATENT DOCUMENTS

| | | | | |
|---|---|---|---|---|
| 2014/0097736 | A1 | 4/2014 | Katsap | |
| 2014/0139100 | A1 | 5/2014 | Kobayashi | |
| 2015/0247178 | A1* | 9/2015 | Mountcastle | C12Q 1/24 435/30 |
| 2016/0074815 | A1* | 3/2016 | Sinton | B01D 69/02 95/49 |

* cited by examiner

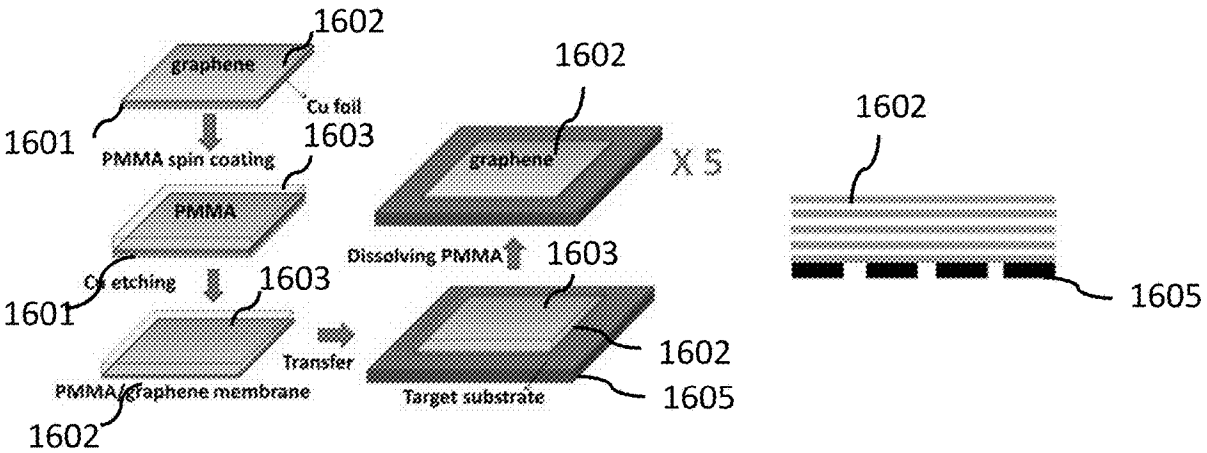
FIG. 16A
FIG. 16B
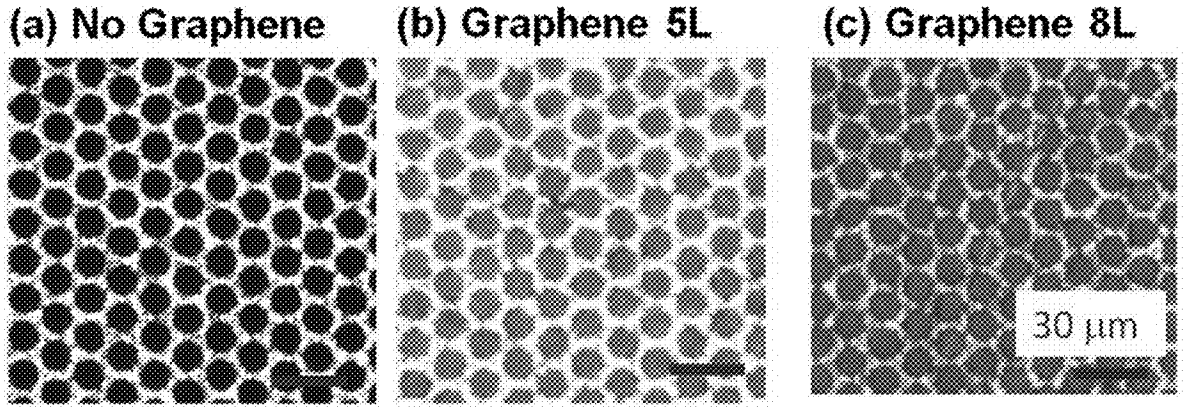
FIG. 17

PHOTOCATHODES WITH PROTECTIVE IN-SITU GRAPHENE GAS BARRIER FILMS AND METHOD OF MAKING THE SAME

CROSS-REFERENCE TO RELATED PATENT APPLICATION

This application claims priority to and the benefit of U.S. Provisional Patent Application No. 62/360,295, filed in the United States Patent and Trademark Office on Jul. 8, 2016, the entire content of which is incorporated herein by reference.

STATEMENT REGARDING FEDERAL RIGHTS

The United States government has rights in this invention pursuant to Contract No. DE-AC52-06NA25396 between the United States Department of Energy and Los Alamos National Security, LLC for the operation of Los Alamos National Laboratory.

FIELD OF THE INVENTION

The present invention generally relates to photocathodes.

BACKGROUND

Photocathodes have been used in opto-electronic devices, such as TV camera tubes, image tubes, motion detectors and counters, etc. High quantum efficiency (QE) and long-life characteristic have been desired for photocathodes. Currently available photocathodes may only last for a matter of hours in the vacuum environment of an electron gun. Their emission efficiency degrades over time in a practical vacuum environment because of trace amount of gases, which contaminates and degrades the sensitive photocathode film. One of the principle challenges for photo-injection is extending the lifetime of high efficiency photocathode operation.

Further, while graphene layers have been contemplated as a protective layer for photocathodes, a macroscopic substrate typically included in conventional photocathodes makes it difficult to exploit features that can only be realistically achieved in free space suspension.

SUMMARY

According to an embodiment of the present disclosure, a photocathode may include: a mesh having a first surface and a second surface facing away from the first surface, and including metallic, semiconductor or ceramic mesh grid with micron-sized openings in the mesh; a photosensitive film on the first surface of the mesh and extending at least partially into the openings of the mesh; and a graphene layer including one or more graphene sheets on the second surface of the mesh.

The graphene layer may include 1 to 5 layers of graphene sheets.

The graphene layer may further include a dopant.

The graphene layer may include 1 to 5 layers of graphene sheets.

The graphene layer may further include a dopant.

The graphene layer may have a first surface in contact with the second surface of the mesh, and a second surface opposite to the first surface, the second surface being a free surface.

The mesh may include a material selected from Ni, Pt, Pd, Cu, Si, or $Si_3N_4$.

The photosensitive film may be selected from a metal; a bi-alkali compound; a multi-alkali compound; an alkali-semiconductor alloy; an alkali-halide; an alkali bi-metallic alloy; polycrystalline diamond; or combinations thereof.

The photosensitive film may be selected from Cu, Ni, Mg, Y, Sm, Ba, Nb, Ca, Au, Mg—Ba, a bi-alkali compound, a multi-alkali compound; $K_2CsSb$, $Cs_3Sb$, KCsSb mixed with CsBr, $K_3Sb$, $Na_2KSb$, $Li_2CsSb$, $Cs_2Te$, CsTe mixed with CsBr, CsKTe, $K_2Te$, $Rb_2Te$, r RbCsTe; CsI; CsI—Ge; GaAs; InGaAs; CsAu, RbAu; polycrystalline diamond; or combinations thereof.

The photocathode may further include a sealing layer on a side of the photosensitive film facing away from the graphene layer.

The sealing layer may include a material selected from the group consisting of NaI, CsBr, CsI, CsF, $MgF_2$, NaF, LiF, SiOx, hexatricontane (HTC), and calcium stearate (CaSt).

The sealing layer may include a first surface in contact with the photosensitive film, and a second surface opposite to the first surface, the second surface being a free surface.

According to another embodiment of the present disclosure, a method for manufacturing a photocathode may include: depositing a graphene layer on a carrier substrate to form a graphene layer-carrier laminate; applying a polymer film on the graphene layer to form a polymer film-graphene layer-carrier laminate; removing the carrier substrate from the polymer film-graphene layer-carrier laminate to form a polymer film-graphene layer laminate; attaching a mesh to the polymer film-graphene layer laminate to form a polymer film-graphene layer-mesh laminate, the mesh comprising metallic, semiconductor or ceramic mesh grid with micron-sized openings in the mesh; removing the polymer film from the polymer film-graphene layer-mesh laminate to form a graphene layer-mesh laminate; and depositing a photosensitive film on the graphene layer-mesh laminate to form a graphene layer-mesh-photosensitive film laminate.

The graphene layer may have a first surface contacting the mesh and the photosensitive film, and a second surface opposite to the first surface, the second surface being a free surface.

The depositing of the graphene layer may be through chemical-vapor-deposition.

The removing of the carrier substrate from the polymer film-graphene layer-carrier laminate may include: etching of the carrier substrate or peeling off of the carrier substrate utilizing a mechanical force.

The applying of the polymer film on the graphene layer may be through spin coating.

The removing of the polymer film from the polymer film-graphene layer-mesh-photosensitive film laminate may include etching the polymer film utilizing acetone.

The attaching of the mesh to the polymer film-graphene layer laminate to form a polymer film-graphene layer-mesh laminate may be through directly contacting the mesh with a surface of the graphene layer opposite to a surface in contact with the polymer film.

The method may further include prior to the depositing of the photosensitive film on the graphene layer-mesh laminate: forming an other polymer film-graphene layer laminate by repeating acts from the depositing of a graphene layer on a carrier substrate to the removing of the carrier substrate from the polymer-graphene layer-carrier laminate; attaching the other polymer film-graphene layer laminate on the graphene layer-mesh laminate to form an other polymer film-graphene layer-mesh laminate; and removing the polymer film from the other polymer film-graphene layer-mesh laminate to form an other graphene layer-mesh laminate.

The method may further include depositing a sealing layer on the photosensitive film to form a graphene layer-mesh-photosensitive film-sealing layer laminate.

The sealing layer may have a first surface in contact with the photosensitive film, and a second surface opposite to the first surface, the second surface being a free surface.

BRIEF DESCRIPTION OF THE DRAWINGS

FIG. 16A is a schematic illustration of a process for transferring a graphene sheet on a target substrate.

FIG. 16B is a cross-sectional view of the substrate with a graphene layer.

FIG. 17 is an optical image of a Ni mesh a) prior to the deposition of the graphene sheet, b) after the deposition of a five-sheet graphene layer, and c) after the deposition of an eight-sheet graphene layer.

DETAILED DESCRIPTION

Figure 1:
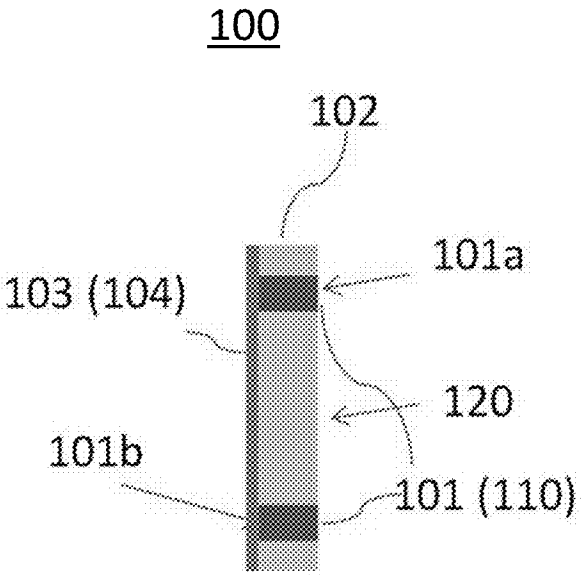
FIG. 1 is a schematic cross sectional view of a photocathode according to an embodiment of the present disclosure.
Figure 2:
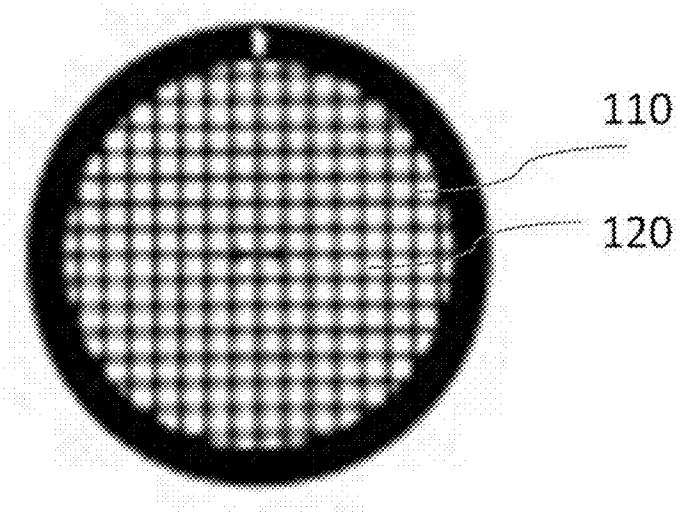
FIG. 2 is a schematic top view of a mesh according to an embodiment of the present disclosure.

Reference will now be made in more detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments of the present disclosure are merely described below, by referring to the figures, to explain aspects of the present description.

As used herein, the term "and/or" includes any and all combinations of one or more of the associated listed items. Expressions such as "at least one of," when preceding a list of elements, modify the entire list of elements and do not modify the individual elements of the list.

As the inventive concept allows for various changes and numerous embodiments, particular embodiments will be illustrated in the drawings and described in more detail in the written description. Effects, features, and a method of achieving the inventive concept will be obvious by referring to exemplary embodiments of the inventive concept with reference to the accompanying drawings. The inventive concept may, however, be embodied in many different forms and should not be construed as being limited to the embodiments set forth herein.

In the embodiments described in the present specification, an expression utilized in the singular encompasses the expression of the plural, unless it has a clearly different meaning in the context. Also, it is to be understood that the terms such as "including," "having," and/or "comprising" are intended to indicate the presence of the stated features or components, and are not intended to preclude the presence or addition of one or more other features or components.

It will be understood that when a layer, region, or component is referred to as being "on" or "onto" another layer, region, or component, it may be directly or indirectly formed on the other layer, region, or component. That is, for example, intervening layer(s), region(s), or component(s) may be present.

Sizes of components in the drawings may be exaggerated for convenience of explanation. In other words, since sizes and thicknesses of components in the drawings are arbitrarily illustrated for convenience of explanation, the following embodiments of the present disclosure are not limited thereto.

A photocathode is a cathode that emits electrons when exposed to radiant energy, especially light. Photocathodes include photosensitive films that, when struck by a quantum of light (photons), convert the absorbed energy to electron emission due to the photoelectric effect. Photocathodes may be characterized by the quantum efficiency (QE) (the ratio of the emitted electrons over the incident photons). U.S. Pat. No. 8,823,259 discloses other parameters typically used to characterize photocathodes, the disclosure of which is incorporated herein in its entirety by reference.

Graphene is generally described as a one-atom-thick planar sheet of sp2-bonded carbon atoms that are densely packed in a honeycomb shaped crystal lattice. Graphene is the basic structural element of some carbon allotropes including graphite, carbon nanotubes and fullerenes. It should be understood that the terms "graphene," and "graphene sheet" as used herein refer only to a single layer or a single sheet of graphene, while the term "graphene layer" may refer to a single sheet of graphene or multiple graphene sheets stacked over one another.

Graphene has many desired (e.g., outstanding) properties which makes it suitable for a photocathode: ultra-high electrical and thermal conductivity, optical transparency, impermeability to molecular gases, high charge mobility, and ability to sustain extreme current densities.

FIG. 1 is a schematic cross sectional view of a photocathode according to an embodiment of the present disclosure. Referring to FIG. 1, according to an embodiment of the present disclosure, a photocathode 100 may include: a mesh (or a grid, used herein interchangeably) 101 having a first surface 101*a* and a second surface 101*b* facing away from the first surface 101*a*. The mesh 101 may be formed of a plurality of wires (also referred to as mesh grids) 110 formed of a metallic, semiconductor or ceramic material. In one embodiment, the mesh 101 is made of metal (e.g., Ni, Pt, Pd, or Cu), semiconductor (e.g., Si), or ceramic (e.g., $Si_3N_4$) materials. The plurality of wires forming the mesh may extend in two or more different directions crossing one another and form a plurality of openings 120 surrounded by the wires 110. The wires of the mesh may be 0.1 microns to 100 microns in diameter. For example, the wires may be 1 to 10 microns in diameter. The openings of the mesh may be 1 to 100 microns in diameter or in length, for example, 2 to 20 microns in diameter or in length.

A photosensitive film 102 is on the first surface 101*a* of the mesh 101 and in openings 120 surrounded by wires 110 (e.g., photosensitive film 102 extends at least partially into the openings) of the mesh 101. The photosensitive film may be formed of any suitable photosensitive materials. For example, suitable photosensitive materials may include a metal, such as Cu, Ni, Mg, Y, Sm, Ba, Nb, Ca, Au, or Mg—Ba; a bi-alkali compound, such as high-temperature bi-alkali compound or low noise bi-alkali compound; a multi-alkali compound; an alkali-semiconductor alloy, such as $K_2CsSb$, $Cs_3Sb$, KCsSb mixed with CsBr, $K_3Sb$, $Na_2KSb$, $Li_2CsSb$, $Cs_2Te$, CsTe mixed with CsBr, CsKTe, $K_2Te$, $Rb_2Te$, or RbCsTe; an alkali-halide, such as CsI; CsI—Ge; GaAs; InGaAs; an alkali bi-metallic alloy such as CsAu, RbAu; polycrystalline diamond; or combinations thereof.

A barrier layer 104 is on the second surface 101*b* of the mesh 101. The barrier layer 104 may be a graphene layer, a graphene oxide layer, and/or a salt layer (such as a LiF layer). In one embodiment, the barrier layer 104 is the graphene layer 103 including one or more graphene sheets.

The photosensitive film 102 is in direct contact with the mesh 101 and the portion of the graphene layer 103 exposed through the openings 120 of the mesh 101.

The graphene layer may include 1 to 20 layers of graphene sheets. For example, the graphene layer may include a single layer of graphene sheet. In another embodiment, the graphene layer may include 2-5 layers of graphene sheets. When the number of graphene sheets is within the ranges described above, the graphene layer provides suitable protection to the photosensitive film against contaminating gases, such as CO, $CO_2$, water vapor, and other oxidizing gases, and also has high optical transparency.

Figure 3:
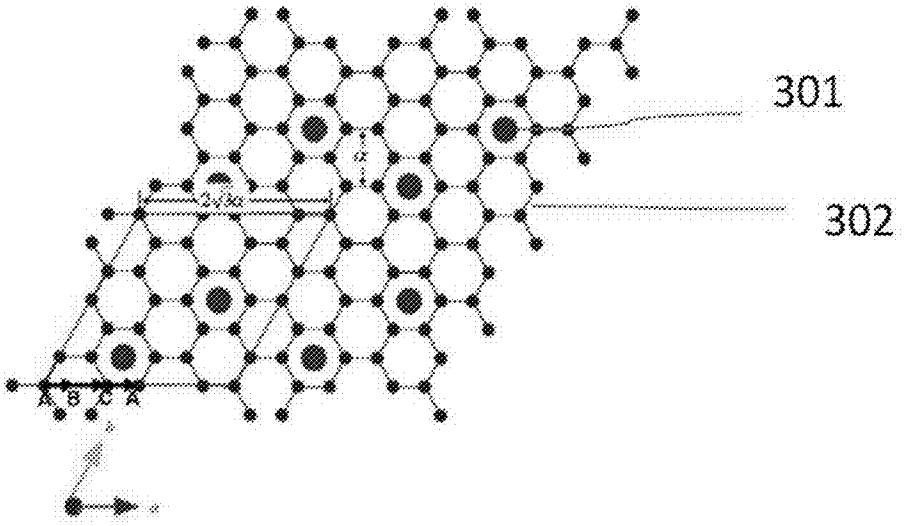
FIG. 3 is a schematic illustration of a graphene sheet including a dopant according to an embodiment of the present disclosure.

In one embodiment, the graphene layer may further include a dopant. A dopant may be included to enhance the brightness of the electron beam emitted by the photocathode, or provide other desired properties, such as high quantum efficiency. For example, the dopant may be Cs, Ca, Na, and/or K. The dopant atom may be intercalated into the graphene crystalline structure, as illustrated in FIG. 3, where a dopant 301 is intercalated into the graphene crystalline structure 302.

Figure 4:
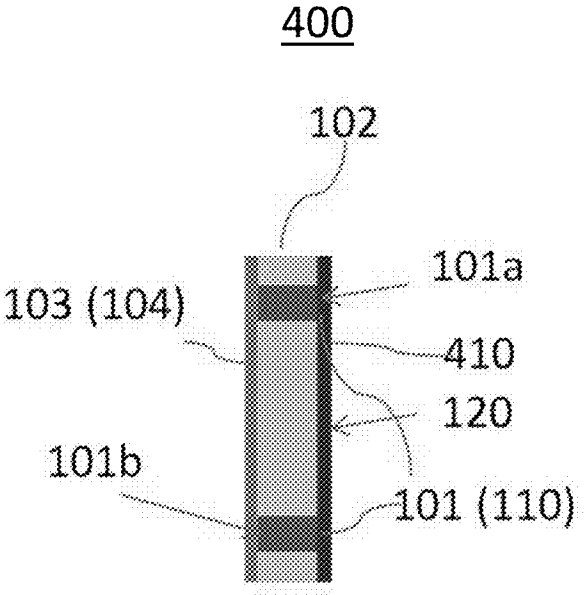
FIG. 4 is a schematic cross sectional view of a photocathode according to an embodiment of the present disclosure.

FIG. 4 is a schematic cross sectional view of a photocathode 400 according to an embodiment of the present disclosure. Referring to FIG. 4, the photocathode 400 may include a mesh 101 having a first surface 101*a* and a second surface 101*b* facing away from the first surface 101*a*. The plurality of wires 110 respectively may extend in two or more different directions crossing one another and form a plurality of openings 120 surrounded by the wires 110. A photosensitive film 102 is on the first surface 101*a* of the mesh 101 and in openings 120 surrounded by wires 110 of the mesh 101. A graphene layer 103 including one or more graphene sheets is on the second surface 101*b* of the mesh 101. Descriptions of the mesh 101, the photosensitive film 102 and the graphene layer 103 are substantially the same as described above in connection with FIG. 1, and will not be repeated herein. The photocathode 400 may further include a sealing layer 410.

The sealing layer 410 may include a material selected from a metal halide (such as NaI, CsBr, CsI, $MgF_2$, NaF, LiF, and CsF), SiOx, hexatricontane (HTC), and calcium stearate (CaSt).

The thickness of the mesh, the thickness of the photosensitive material, the thickness of the graphene layer, and the thickness of the sealing layer may be any suitable value for each of these layers to perform their respective functions.

For example, the graphene layer may be about 0.3 nm to less than 40 nm, for example, about 0.3 nm to about 1.5 nm thick. When the thickness of the graphene layer is within the ranges described above, satisfactory barrier properties can be achieved without sacrificing light transmission. However, if the graphene layer has a thickness of 40 nm or thicker, it is not suitable for a transmission mode photocathode due to poor light transmission.

The sealing layer may be about 1 nm to about 100 nm thick, for example, about 2 nm to about 5 nm thick.

The photosensitive film may have a thickness suitable for the application of the photosensitive device in which it is employed, for example, the photosensitive film may have a thickness of 10 nm to 1000 nm, for example, 100 nm to 500 nm.

The photocathode according to one or more embodiments of the present disclosure may include, on the graphene side, only the graphene layer attached to the mesh. That is, there are no additional layers of other materials attached to the graphene layer that is in contact with the mesh and the photosensitive material. Here, one surface of the graphene layer is in contact with the mesh and the photosensitive material, and the opposite surface is a free surface. Further, the photocathode according to one or more embodiments of the present disclosure may include, on the sealing layer side, only the sealing layer attached to the photosensitive material. That is, there are no additional layers of other materials attached to the sealing layer that is in contact with the photosensitive material. For example, in one embodiment, the photocathode of the present disclosure is free of a cathode substrate included in a conventional photocathode. In one embodiment, a photocathode includes only the above described graphene layer, mesh, photosensitive material layer and sealing layer, and is free of any additional layer or substrate.

Figure 5A:
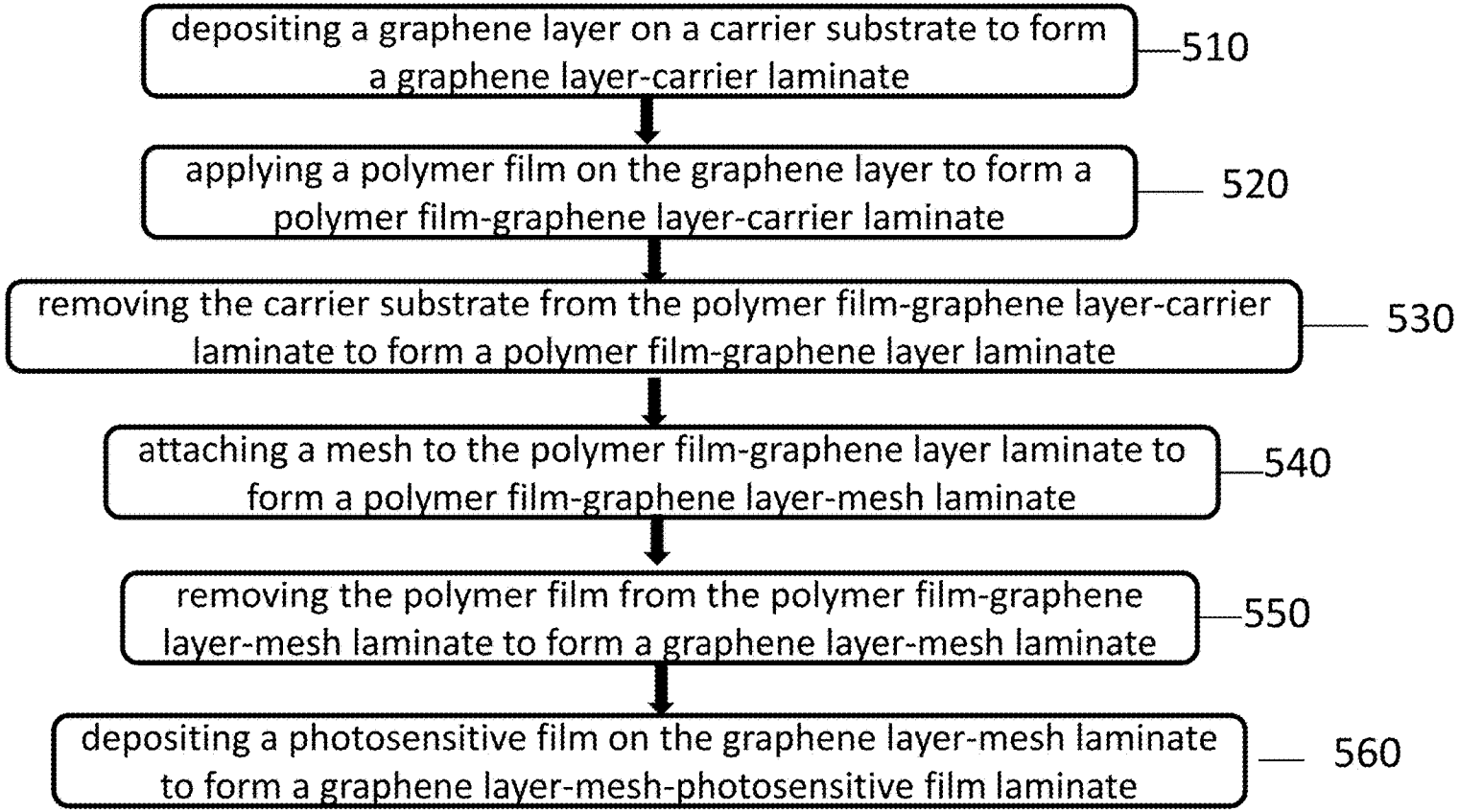
FIGS. 5A and 5B are flow charts respectively illustrating a method of manufacturing a photocathode according to an embodiment of the present disclosure.
Figure 5B:
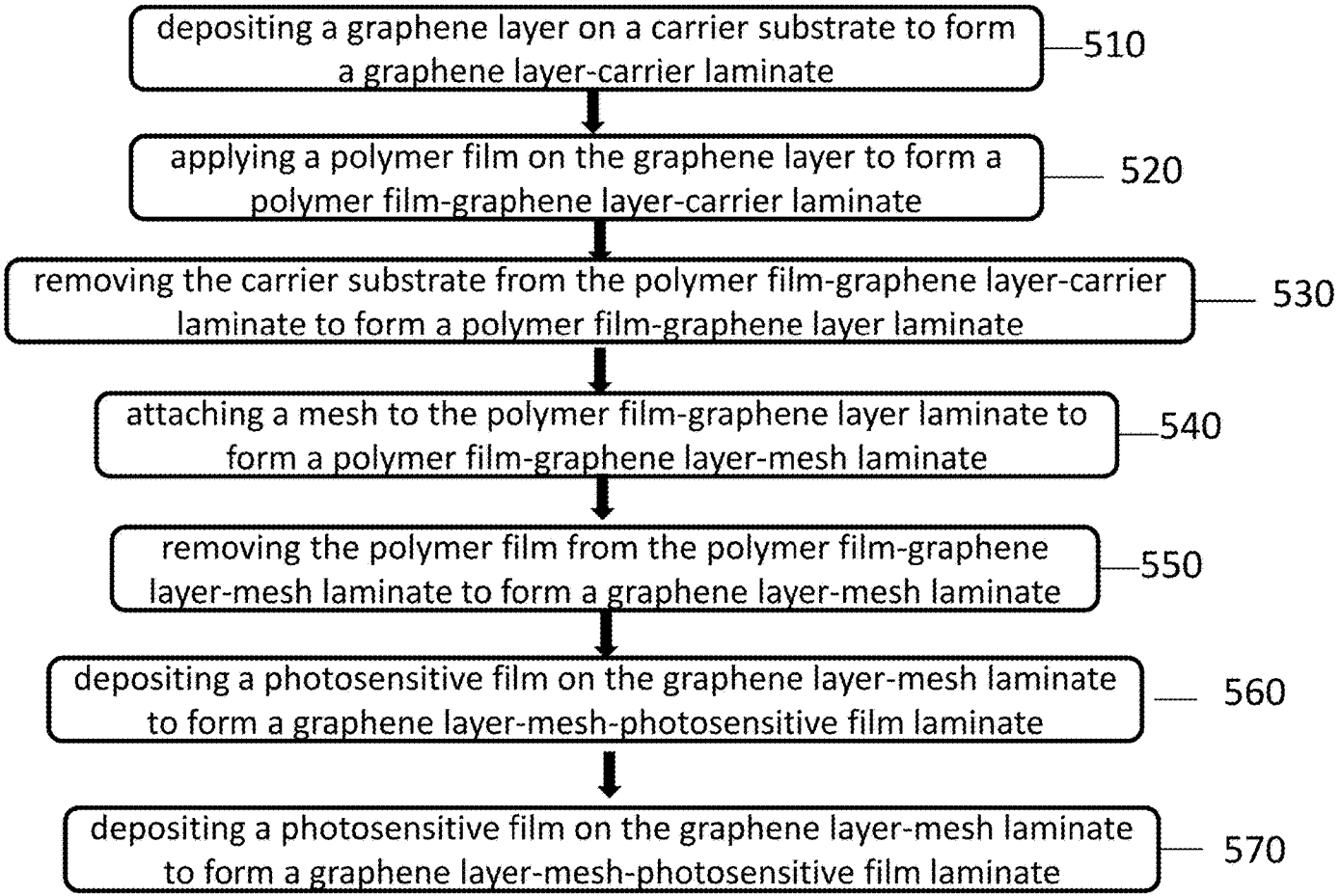

FIGS. 5A and 5B are flow charts respectively illustrating a method of manufacturing a photocathode according to an embodiment of the present disclosure.

Referring to FIG. 5A, according to another embodiment of the present disclosure, a method for manufacturing a photocathode may include: depositing a graphene layer on a carrier substrate to form a graphene layer-carrier laminate (act 510); applying a polymer film on the graphene layer to form a polymer film-graphene layer-carrier laminate (act 520); removing the carrier substrate from the polymer film-graphene layer-carrier laminate to form a polymer film-graphene layer laminate (act 530); attaching a mesh to the polymer film-graphene layer laminate to form a polymer film-graphene layer-mesh laminate (act 540), the mesh including metallic, semiconductor or ceramic mesh grid with micron-sized openings in the mesh; removing the polymer film from the polymer film-graphene layer-mesh laminate to form a graphene layer-mesh laminate (act 550); and depositing a photosensitive film on the graphene layer-mesh laminate to form a graphene layer-mesh-photosensitive film laminate (act 560). The method may further include depositing a sealing layer on the photosensitive film to form a graphene layer-mesh-photosensitive film-sealing layer laminate (act 570), as shown in FIG. 5B.

The carrier substrate may be any suitable material that can stand the graphene layer deposition process and not chemically interfering with the graphene layer. For example, the carrier substrate may be Cu foil or Ni foil. The carrier substrate may be pre-treated by an annealing process prior to the deposition of the graphene layer. For example, the carrier substrate may be heated at 400° C. for at least two hours in at least 1E-8 Torr vacuum.

The depositing of the graphene layer may be through chemical-vapor-deposition (CVD). High temperatures are required for graphene growth and the temperature is typically at 900° C. or higher. The conditions for depositing the graphene layer may be any suitable condition. For example, the graphene layer may be formed in a CVD process conducted at 1000° C. utilizing $CH_4/H_2$. However, embodiments of the present disclosure are not limited thereto.

Figures 6A, 6B, 6C, 6D:
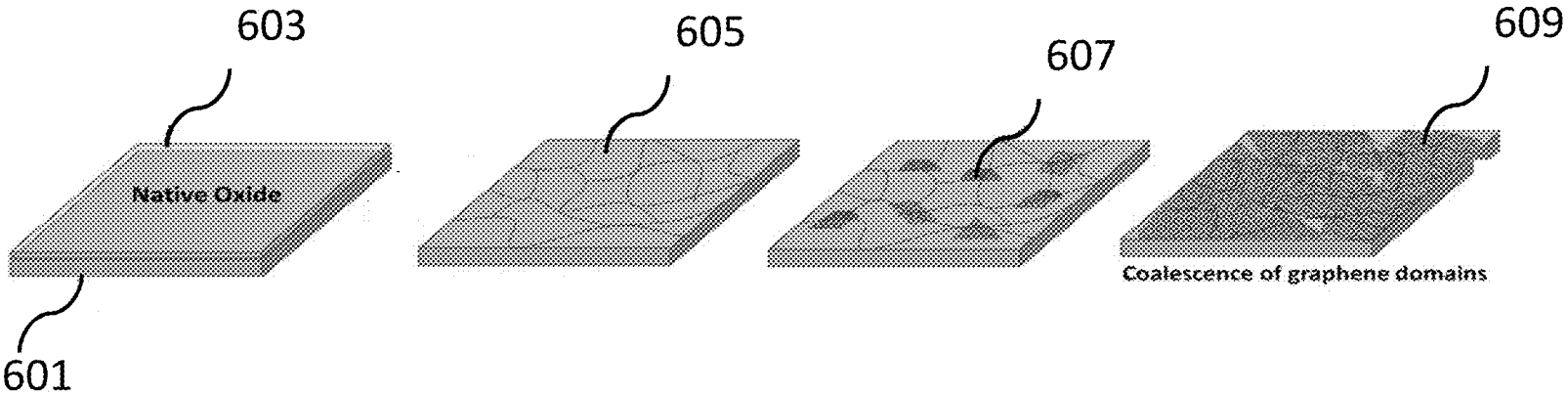
FIGS. 6A to 6D are schematic illustrations of a process of depositing a graphene layer on a substrate.

FIGS. 6A to 6D are schematic illustrations of a process of depositing a graphene layer on a substrate. Referring to FIG. 6A, a carrier substrate 601 is provided. The carrier substrate 601 may include a native oxide layer 603 on a surface thereof. After an annealing process has been conducted, as shown in FIG. 6B, the native oxide 603 is removed from the carrier substrate 601 and a clean surface 605 of the carrier substrate is exposed. After the substrate is loaded into a CVD chamber and $CH_4/H_2$ is provided in the CVD chamber at a set or predetermined flow rate, isolated graphene domains 607 are deposited on the substrate, as shown in FIG. 6C. For example, $CH_4$ may be supplied at 20 standard cubic centimeters per minute (sccm) and $H_2$ may be supplied at 10 sccm. The CVD chamber is maintained at about 1000° C. The graphene domains then grow and coalescence into the graphene layer 609 (e.g., a single layer of graphene) as shown in FIG. 6D.

The polymer film may be applied on the graphene layer-carrier laminate through any suitable method, such as spin coating. The polymer film may be made of a suitable material, such as PMMA.

The removing of the carrier substrate from the polymer film-graphene layer-carrier laminate may include: etching away the carrier substrate, or peeling the carrier substrate away utilizing a mechanical force. The etching may be conducted utilizing a suitable etchant, for example, an acid including a blend of $HNO_3$, $H_3PO_4$ and $H_2O$, and the etching may be conducted for about 2 to 6 hours. In one embodiment, the polymer film-graphene layer laminate may be transferred to the target substrate, or an intermediate substrate, such as a $Si/SiO_2$ substrate, to be followed by drying of the polymer film-graphene layer laminate.

In another embodiment, the carrier substrate may be removed through a mechanical force. For example, the carrier substrate may be peeled off from the polymer film-graphene layer-carrier laminate by a mechanical force.

The attaching of the mesh to the polymer film-graphene layer laminate to form a polymer film-graphene layer-mesh laminate may be simply realized by bringing the free surface of the graphene layer (i.e., the side opposite to the one in contact with the polymer film) to be in contact with a surface of the mesh. It is believed that the van der Waals force forms a strong bond between the graphene layer and the mesh, and between adjacent graphene sheets when a plurality of graphene sheets are individually formed and stacked together afterwards. However, embodiments of the present disclosure are not limited thereto.

The removing of the polymer film from the polymer film-graphene layer-mesh laminate may include etching the polymer film utilizing a suitable solvent, such as acetone. The surface of the graphene layer from which the polymer layer is removed may be treated using a thermal cleaning procedure comprised of sustained heating at 400° C. for at least two hours in at least 1E-8 Torr vacuum.

The depositing of the photosensitive film on the mesh may be conducted utilizing any suitable method, for example, by chemical vapor deposition. The photosensitive material is deposited to be in contact with a free surface of the mesh (i.e., the surface opposite to the one in contact with the graphene layer), and also is deposited in the openings in the mesh surrounded by the wires. The photosensitive material deposited in the openings is also in contact with the graphene layer exposed through the openings. A graphene layer-mesh-photosensitive film laminate is thereby manufactured. That is, a photocathode with a graphene layer is manufactured.

Additional graphene sheets may be deposited on the carrier substrate and transferred to the graphene side of the graphene layer-mesh-photosenstive film laminate to provide a graphene layer with multiple graphene sheets. Alternatively, multiple graphene sheets may be deposited on the carrier substrate first, and then laminated with the mesh prior to the deposition of the photosensitive film.

The sealing layer may be deposited utilizing a suitable method, such as chemical vapor deposition.

Figure 7:
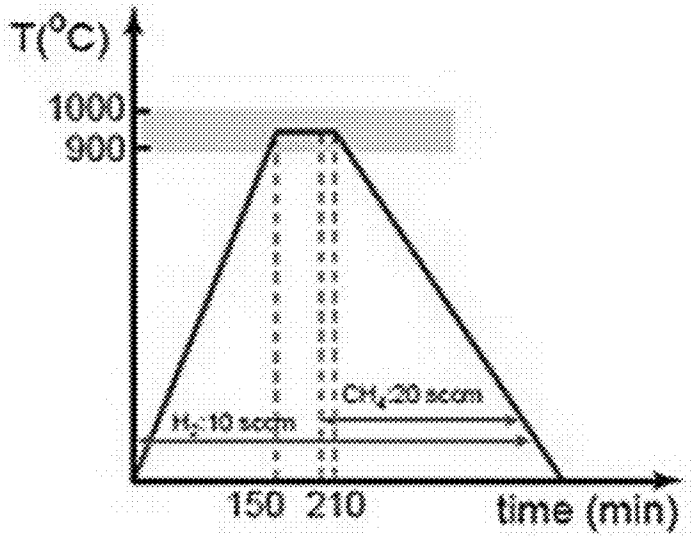
FIG. 7 illustrates a process condition (temperature profile and $CH_4$ and $H_2$ concentration) during the deposition of a single layer graphene sheet.

FIG. 7 illustrates a process condition (temperature profile and $CH_4$ and $H_2$ concentration) during the deposition of a single layer graphene sheet. Referring to FIG. 7, the deposition chamber is supplied with $H_2$ at a constant rate of 10 sccm and the temperature is raised at a constant rate from ambient temperature to about 950° C. in 150 mins. The temperature is then kept constant for about 1 minute. At the end of the 1 minute of constant temperature, $CH_4$ is supplied at a rate of 20 sccm till the end of the deposition process. The temperature is then decreased back to ambient condition at a constant rate. Graphene deposition may be conducted using a commercially available diamond growth chamber (e.g., Kurt J. Lester or equivalent) or a custom-designed vacuum system with similar capabilities.

Example 1

A single crystalline Cu foil (hereinafter referred to as a Cu substrate or an un-coated Cu substrate) was loaded into a commercially available diamond growth chamber (e.g., Kurt J. Lester or equivalent). The reactor chamber was then evacuated to a base pressure, backfilled with $H_2$ at a constant rate of 10 sccm, heated to 1000° C., and maintained at 40 mTorr pressure. $CH_4$ was then supplied at a rate of 20 sccm to yield a total chamber pressure of 500 mTorr. Afterwards, the chamber is cooled at a rate of 10-50° C./min to thereby complete the deposition of a graphene layer on the Cu substrate.

Figure 9:
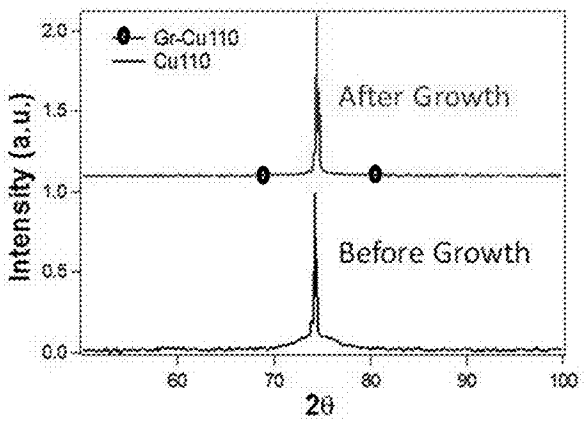
FIG. 9 shows the XRD pattern of the (110) plane of Cu before and after the deposition of a graphene layer according to the conditions shown in FIG. 7.
Figure 8:
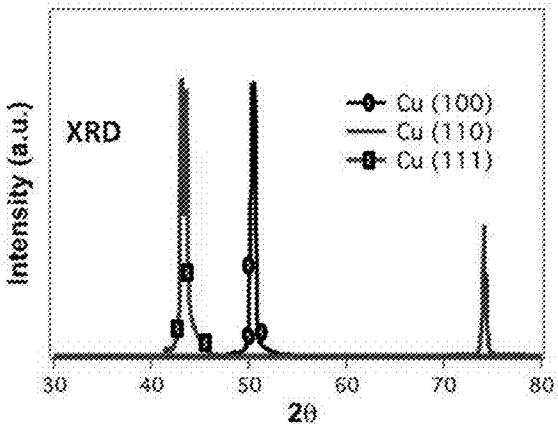
FIG. 8 shows the x-ray diffraction (XRD) pattern of a single crystalline Cu substrate.

FIG. 8 shows the x-ray diffraction (XRD) pattern of the single crystalline Cu substrate. FIG. 9 shows the XRD pattern of the (110) plane of Cu before and after the deposition of a graphene layer. As shown in FIGS. 8 and 9, no significant change can be observed in the XRD pattern of the (110) plane of the Cu substrate as a result of the deposition of the graphene layer.

Figure 11:
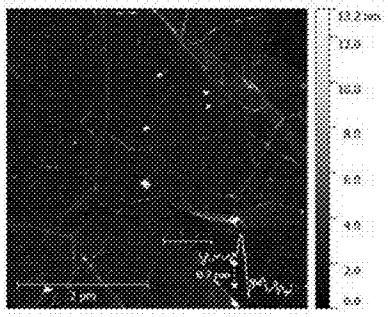
FIG. 11 is an AFM image of the graphene layer coated on the Cu substrate utilizing the condition shown in FIG. 7.
Figure 10:
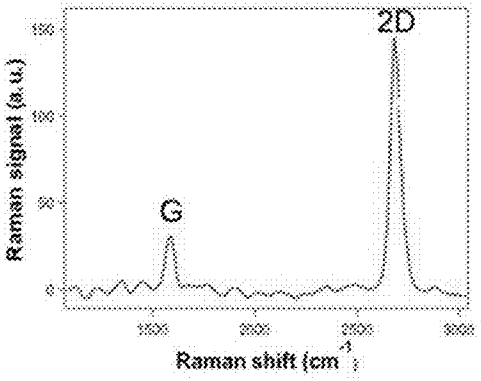
FIG. 10 shows the Raman spectrum of graphene.

FIG. 10 shows the Raman spectrum of graphene. As shown in FIG. 10, the graphene layer has no visible D peak, and has a 2D/G ratio of greater than 3. FIG. 11 is an AFM image of the graphene layer coated on the Cu substrate utilizing the condition shown in FIG. 7. The AFM measurement shows that the graphene layer has a thickness of about 0.7 nm, which indicates that the graphene layer is a monolayer (i.e., a single layer of graphene sheet).

Figure 12:
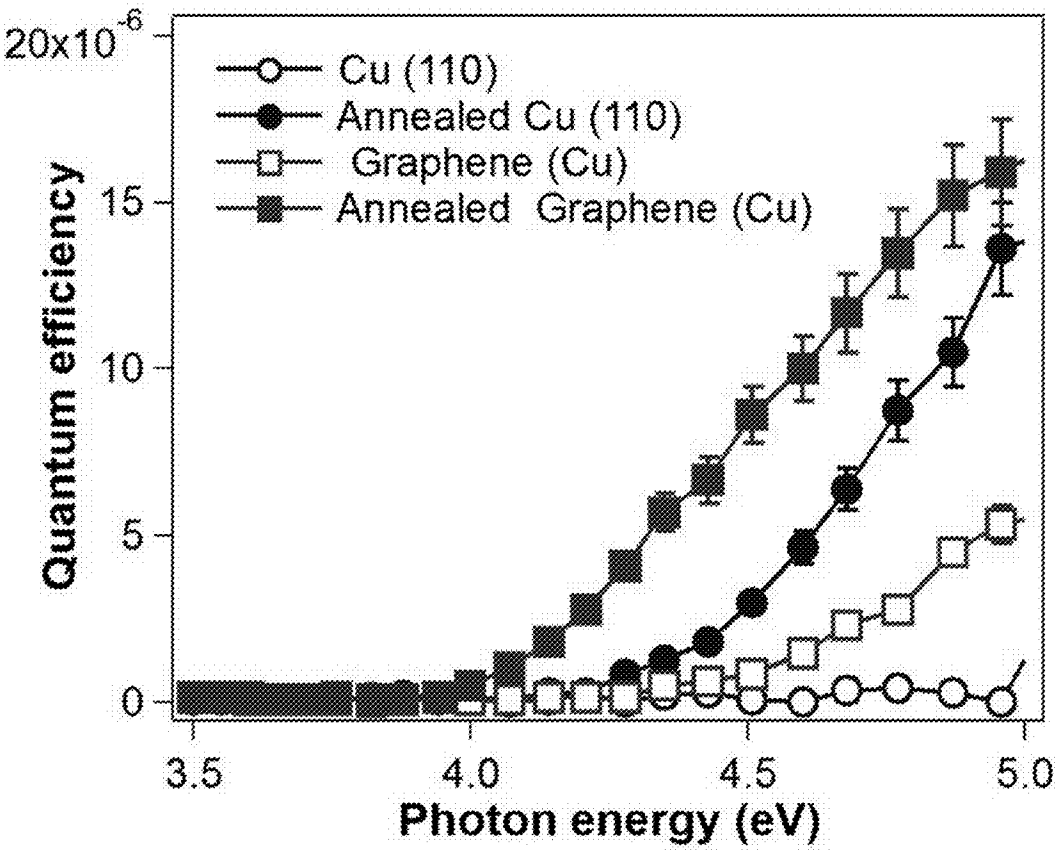
FIG. 12 shows the quantum efficiency of a Cu substrate, an annealed Cu substrate, a graphene coated Cu substrate manufactured according to the conditions shown in FIG. 7, and the graphene coated Cu substrate after being annealed.

FIG. 12 shows the quantum efficiency of a Cu substrate, an annealed Cu substrate, a graphene coated Cu substrate manufactured according to the conditions shown in FIG. 7, and the graphene coated Cu substrate after being annealed. The annealing was conducted at 345° C. for 1 hour. As can be observed from FIG. 12, the graphene (e.g., the single graphene sheet) coated Cu substrate shows immediate photo response even without any additional processing, such as cleaning, after the deposition of the graphene layer. Further, it can be observed that the annealing process is effective to recover the quantum efficiency of both the Cu substrate (i.e., the un-coated Cu substrate) and the graphene coated Cu substrate. Also, the graphene coated Cu substrate demonstrated photoemission at a lower work function than the one without the graphene coating (e.g., at a difference of about 0.25 eV).

Figure 13:
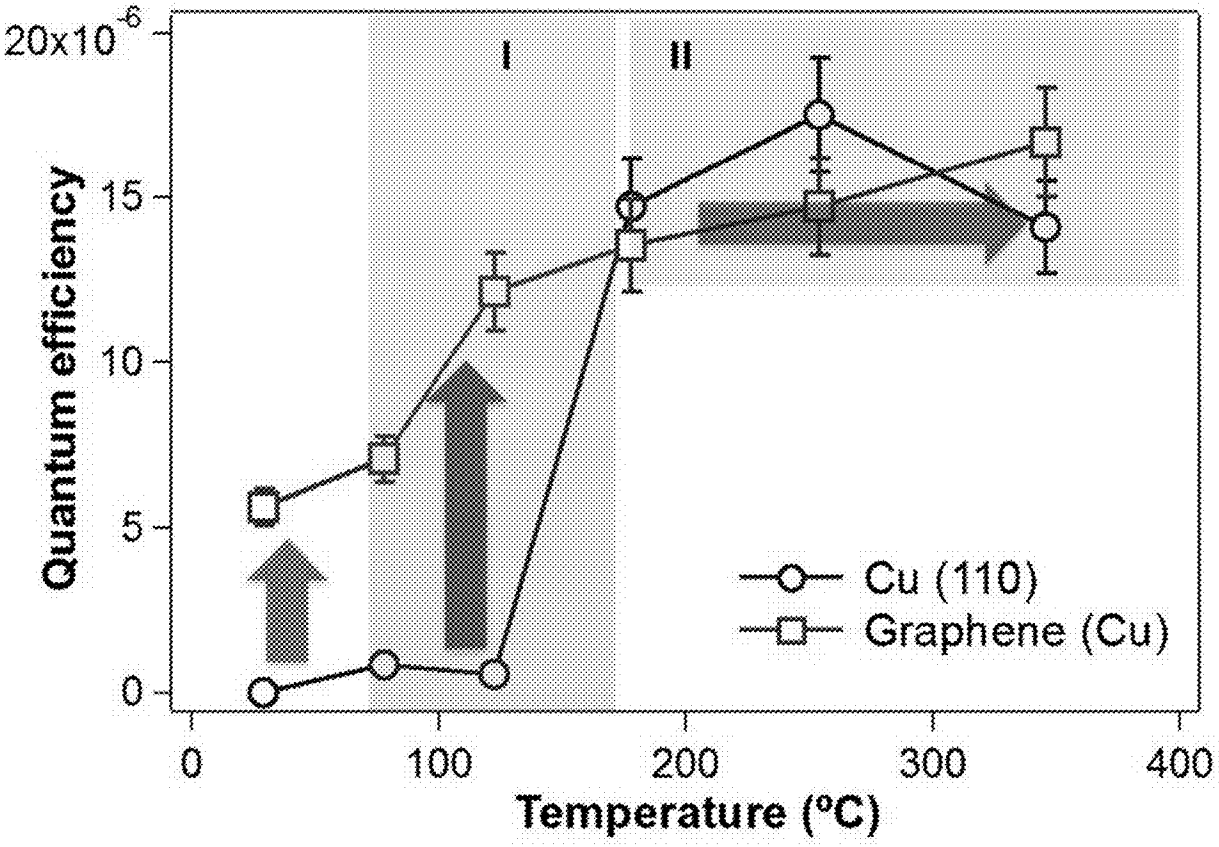
FIG. 13 shows the quantum efficiency of a Cu substrate and a graphene coated Cu substrate manufactured according to the conditions shown in FIG. 7 as a function of temperature.

FIG. 13 shows the quantum efficiency of a Cu substrate and a graphene coated Cu substrate manufactured according to the conditions shown in FIG. 7 as a function of temperature. As shown in FIG. 13, at room temperature, the graphene coated Cu substrate demonstrates higher quantum efficiency. FIG. 13 also shows that the quantum efficiency of the Cu substrate increases significantly between a temperature higher than 100° C. and 200° C., indicating water desorption. At about 200° C. or higher, the quantum efficiency of the Cu substrate (i.e., un-coated Cu substrate) and that of the graphene coated Cu substrate are similar to each other (i.e., about the same).

Figure 14:
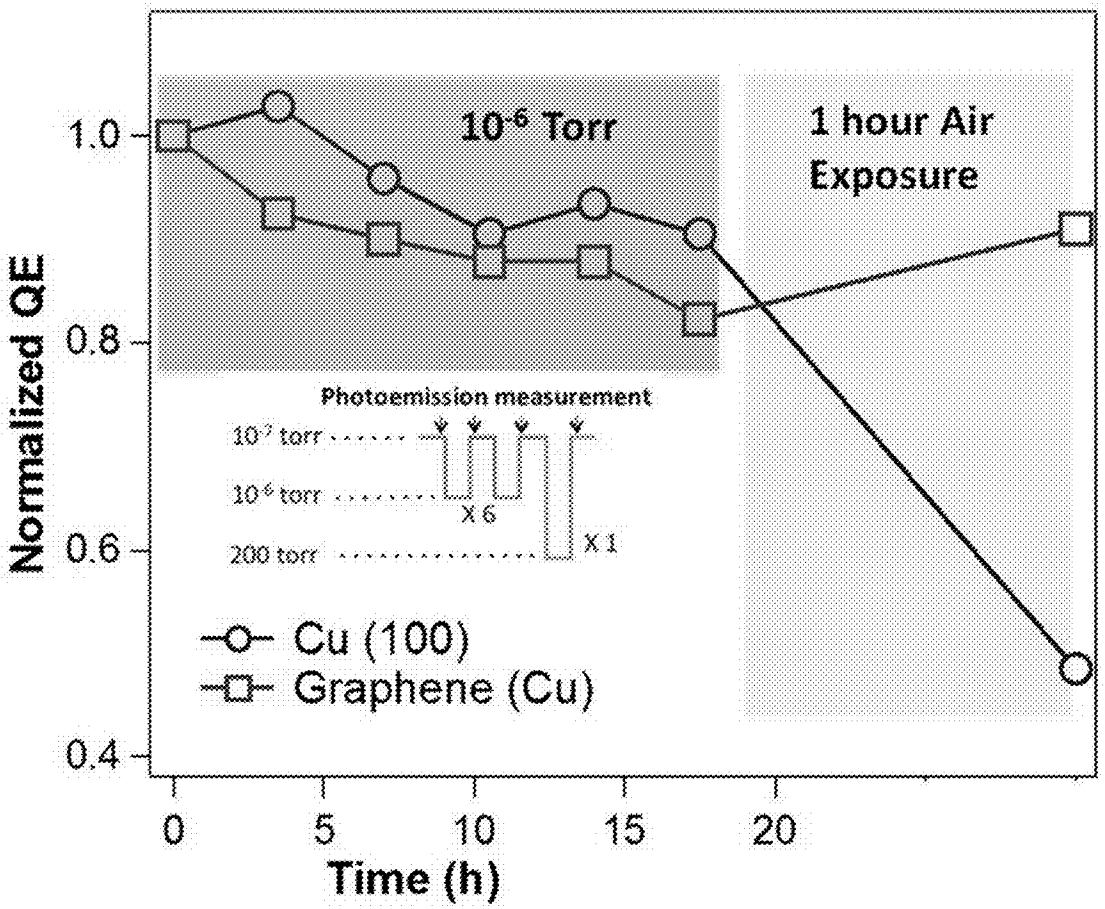
FIG. 14 shows the normalized quantum efficiency of a Cu substrate and a graphene coated Cu substrate manufactured according to the conditions shown in FIG. 7 as a function of time.

FIG. 14 shows the normalized quantum efficiency of a Cu substrate and a graphene coated Cu substrate manufactured according to the conditions shown in FIG. 7 as a function of time. In obtaining the data shown in FIG. 14, the quantum efficiency of a fresh sample is measured at a pressure of $10^{-1}$torr and recorded as the quantum efficiency at time zero. The sample is then repeatedly exposed to $10^{-6}$ torr for a given duration of time, and brought back to $10^{-7}$ for the measurement of its quantum efficiency at the end of the duration of time as shown in the insert of FIG. 14. In more detail, after the measurement at time zero, the sample is exposed to $10^{-6}$ torr for a first duration of time. The quantum efficiency of the sample after the first exposure is then measured at the pressure of $10^{-7}$ torr. After the measurement, the sample is then exposed to $10^{-6}$ for a second duration of time, and bring back to $10^{-7}$ for the measurement of its quantum efficiency. This process is repeated for a total of 18 hours. The sample is then exposed to air at 200 torr for one hour, after which, the pressure was brought back to $10^{-7}$ torr for the measurement of its quantum efficiency. Each data point shown in FIG. 14 is an average value for measurement results on three samples.

The normalized quantum efficiency is calculated according to the following equation 1:

$$\text{normalized quantum efficiency} = \text{quantum efficiency at a given time} / \text{quantum efficiency at time zero}$$

As shown in FIG. 14, the exposure to $10^{-6}$ torr leads to a similar decrease in the quantum efficiency in both the Cu substrate and the graphene coated Cu substrate. However, when exposed to air for 1 hour, the quantum efficiency of the Cu substrate decreases significantly, while that of the graphene coated Cu substrate remains relatively constant. Further, both Cu (110) and Cu (111) have shown similar results.

Figure 15:
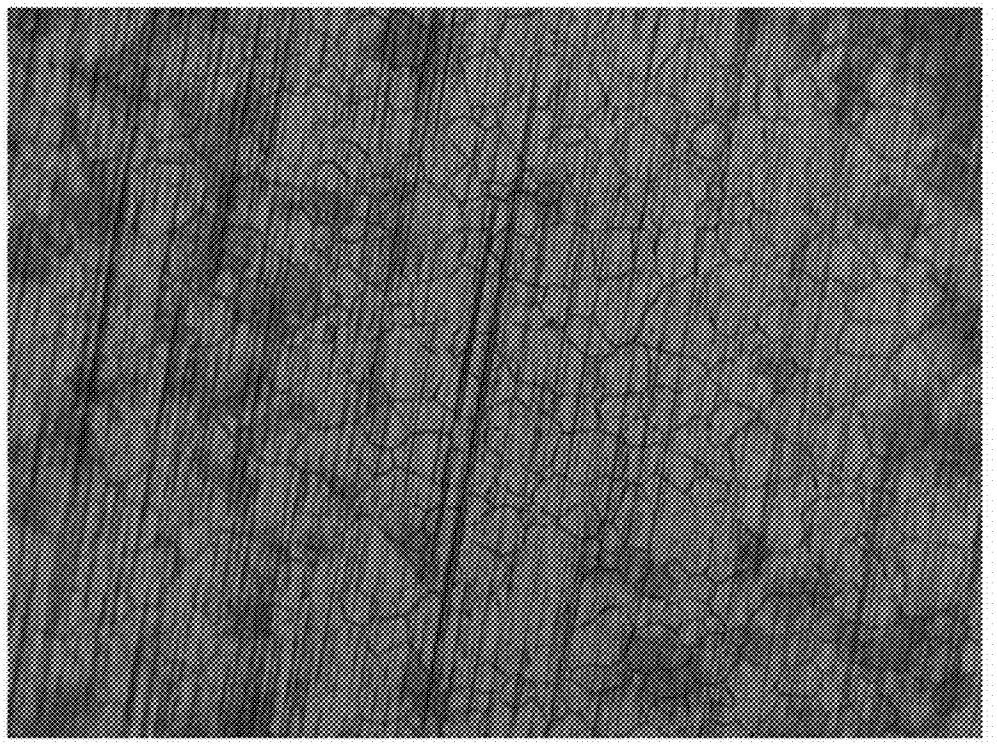
FIG. 15 is an optical image of the graphene layer-carrier substrate laminate taken from the graphene side.

In one embodiment, a graphene layer-carrier substrate is first prepared according to the condition shown in FIG. 7 except for utilizing Ni foil as the carrier substrate and graphene was deposited at a temperature of 1000° C. FIG. 15 is an optical image of the graphene layer-carrier substrate laminate taken from the graphene side.

PMMA was then spin coated on the graphene layer-carrier substrate laminate at an RPM of about 1500. The polymer was then allowed to interact with the substrate for about 3 minutes, after which, the sample was dried at 80° C. on a hot plate. The Ni foil was then removed from the thus formed polymer film-graphene layer-carrier substrate laminate through acid etching. The sample was soaked in an acid blend including $HNO_3$, $H_3PO_4$ and $H_2O$ mixed at a volumetric ratio of 1:1:1 for about 4 hours. The polymer film-graphene layer laminate obtained after the acid etching was then transferred to a Si wafer and dried at 80° C. on a hot plate. PMMA was then etched off utilizing acetone. The sample was soaked in acetone for 15 minutes each and repeated three times. After the acetone etching, the sample was washed with deionized water (DI-$H_2O$), and dried at 80° C. on a hot plate.

FIG. 16A is a schematic illustration of a process for transferring a graphene sheet on a target substrate and FIG. 16B is a cross-sectional view of the substrate with a graphene layer. As shown in FIG. 16A, a graphene layer 1602 (e.g., a single graphene sheet) is first deposited on a carrier substrate 1601, e.g., a Cu foil. A polymer film 1603, e.g., a PMMA film is then deposited, e.g., through spin coating, on the graphene layer 1602. Next, the carrier substrate 1601 is removed through, e.g., etching, to provide a polymer film-graphene layer laminate. The polymer film-graphene layer laminate is transferred to the target substrate 1605 by contacting the graphene layer with the target substrate. Lastly, the polymer film is removed through, e.g., dissolving the polymer film to produce a target substrate 1605 with a graphene layer 1602 attached. This process may be repeated multiple times to produce a graphene layer with multiple graphene sheets. FIG. 16B shows a graphene layer 1602 with 5 graphene sheets is deposited on a mesh substrate 1605.

Figure 18:
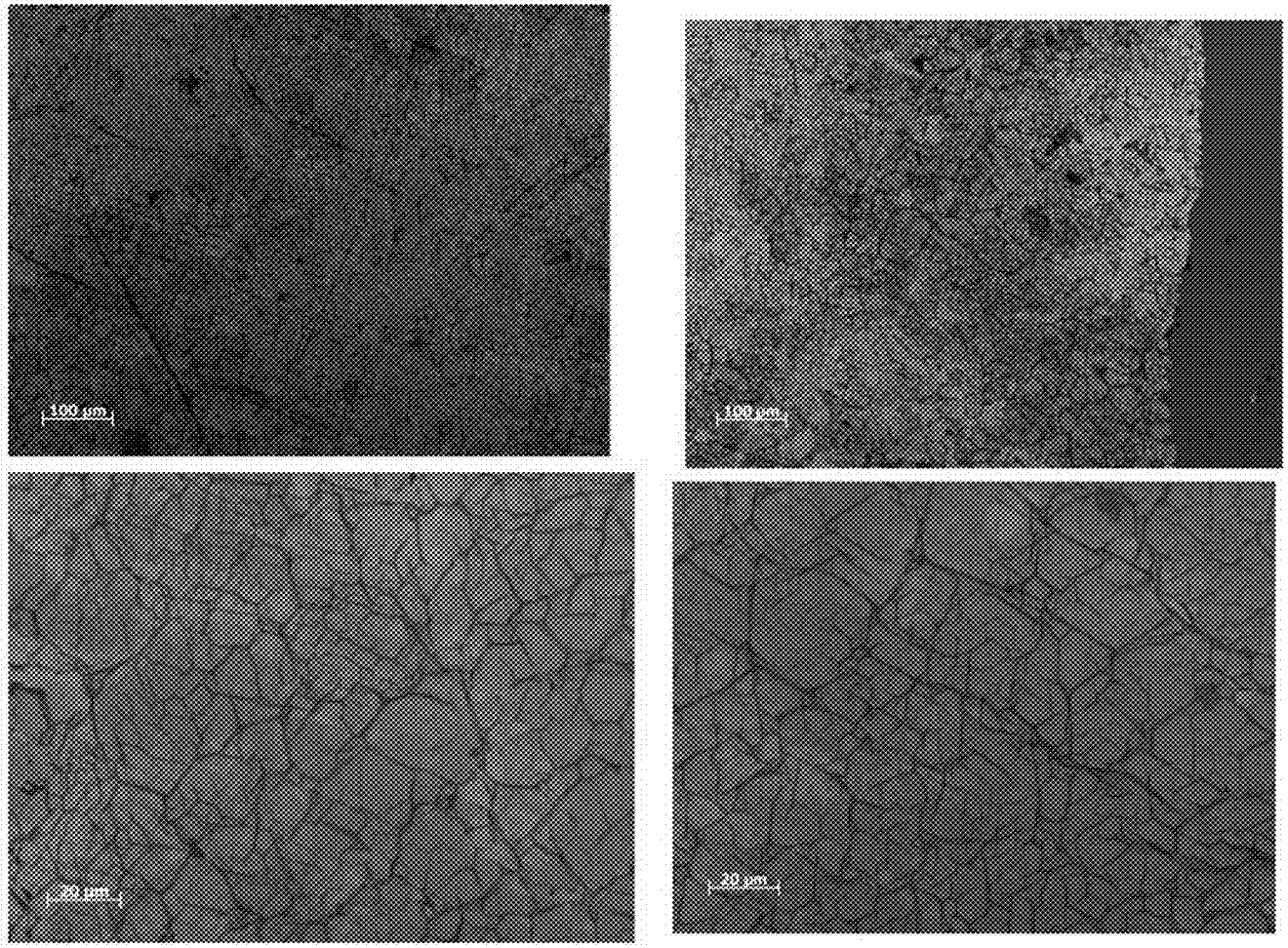
FIG. 18 shows optical images of a thick graphene layer.

FIG. 17 is an optical image of a Ni mesh a) prior to the deposition of the graphene sheet, b) after the deposition of a five-sheet graphene layer, and c) after the deposition of an eight-sheet graphene layer. As shown in FIG. 17, 5 layers of graphene sheets can provide complete coverage of the target substrate. FIG. 18 shows optical images of a thick graphene layer at various manginifications.

Figure 20:
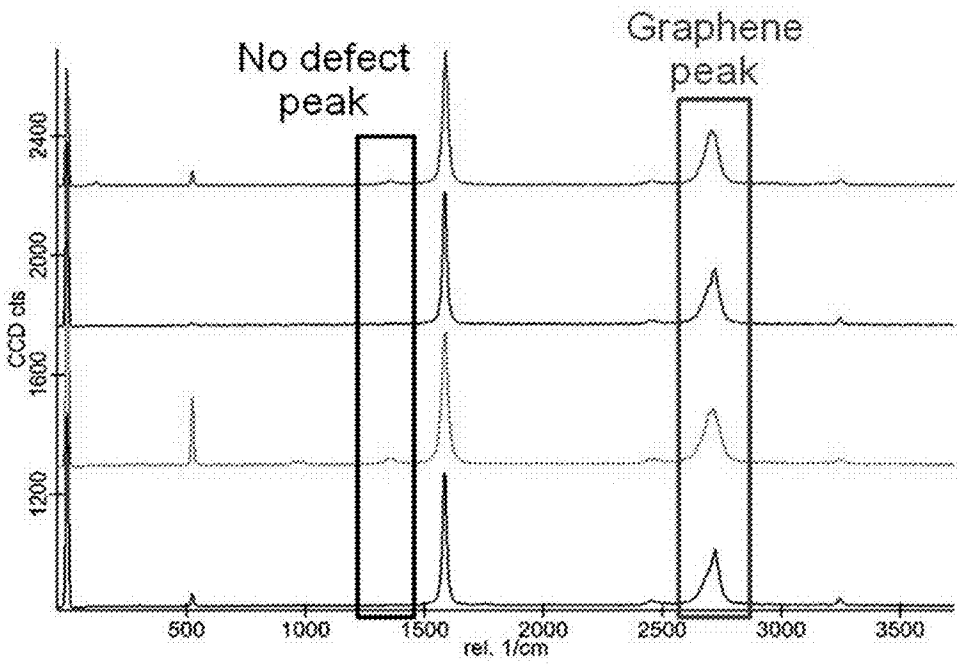
FIG. 20 is a Raman spectrum on the graphene layer shown in FIG. 19.
Figure 19:
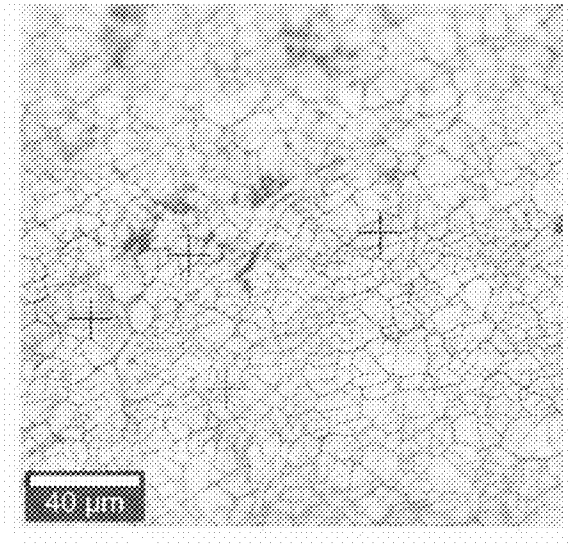
FIG. 19 shows an optical image of a 40 nm thick graphene layer grown on a Ni substrate.

FIG. 19 shows an optical image of a 40 nm thick graphene layer grown on a Ni substrate. FIG. 20 is a Raman spectrum of the graphene layer shown in FIG. 19. As seen from FIG. 20, no significant defect peaks are detected in the graphene layer.

Example 2

Figure 21:
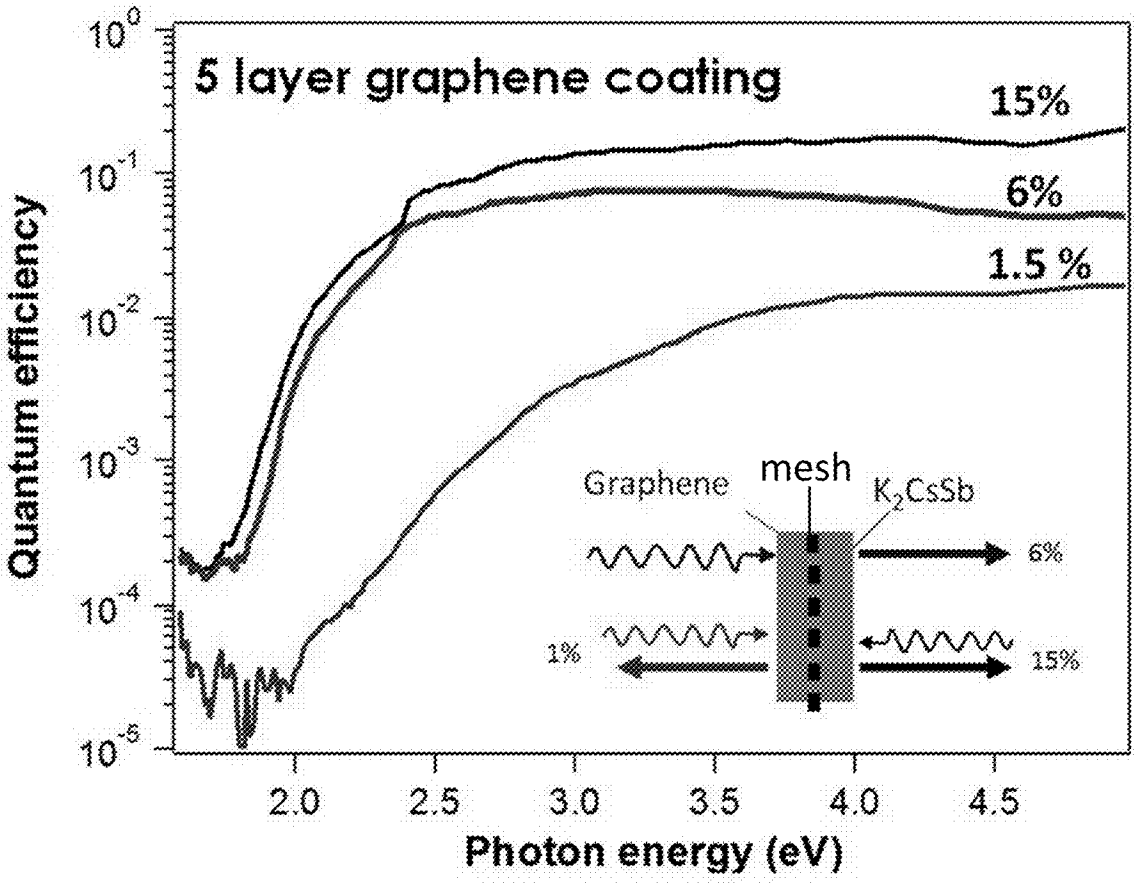
FIG. 21 is a plot showing the effect of photon energy on the quantum efficiency of a photocathode with a five layer graphene sheet.

Five layers of graphene sheets were transferred to one side of a Ni mesh, and $K_2CsSb$ was deposited to the other side of the Ni mess, thereby manufacturing a photocathode with five layers of graphene sheets. The quantum efficiency of the photocathode is measured as a function of photon energy and the results are shown in FIG. 21. As shown and illustrated in FIG. 21, the photocathode reaches a quantum efficiency of 15% in the reflection mode, a quantum efficiency of 6% in the transmission mode when light comes in from the graphene side, and a quantum efficiency of 1.5% in the transmission mode when light comes in from the photosensitive material side.

While transferring of the graphene sheets from a carrier substrate to a mesh has been described above, embodiments of the present disclosure are not limited thereto. For example, the graphene layer may be directly deposited on the target substrate. In one embodiment, a metal photocathode is first deposited on a suitable substrate, such as silicon wafer, and a graphene layer is directly deposited on the metal photocathode through chemical vapor deposition. The terms "deposited" and "transferred" are used herein interchangeably with respect to the graphene layer.

The method for manufacturing of a photocathode according to embodiments of the present disclosure allows the photosensitive films, critical in many detection and electron emission applications, to be deposited (or grown) on vanishingly small substrates (e.g., a graphene layer) that are suspended in free space (i.e., without the macroscopic substrate utilized in conventional photocathodes). The photosensitive film according to embodiments of the present disclosure is encapsulated in a manner that preserves photosensitivity but prevents chemical degradation. Traditional metallic and semiconductor films (common, for example, in semiconductor devices and state of the art in photocathodes) require a macroscopic substrate for both support and electrical interface. This practical requirement limits the functionality of such films because features and properties that manifest only in free space suspension may not be accessible to or manifested in devices manufactured relying on macroscopic substrates.

A highly desirable feature of the present disclosure is the ability to grow a traditional photocathode film on a transparent suspended substrate that is only a few monolayers (atomic layers) thick. The diminutive dimensions of the substrate allow for electron tunneling of excited electrons through the transparent layer. A layer on either side of the photosensitive film allows for a.) protective encapsulation of the photocathode film, preventing it from being damaged by ions and contaminating trace amount of gases in vacuum; b.) un-inhibited electron emission from the photocathode; and c.) direct charge injection into the cathode itself. Additionally, the transparent and thin (e.g., graphene monolayer) substrate can be controllably doped to optimize performance. The graphene is held suspended on a scaffold of metallic or semiconductor micron-sized mesh which provides micron-level support of the suspended transparent substrate as well as a method of electrically interfacing with the device.

The foregoing description of the preferred embodiments of the invention has been presented for purposes of illustration and description and is not intended to be exhaustive or to limit the claimed invention to the precise form disclosed. Those of skill in the art will readily appreciate that many modifications and variations to the claimed invention are possible in light of the above teaching. The embodiments were chosen and described in order to best explain the principles of the invention and its practical application to thereby enable others skilled in the art to best utilize the invention in various photocathode embodiments and with various modifications as are suited to the particular use contemplated. It is intended that the scope of the invention be defined exclusively by the following claims, and equivalents thereof.

We claim:

1. A method for manufacturing a photocathode, the method comprising:

depositing a graphene layer on a carrier substrate to form a graphene layer-carrier laminate;

applying a polymer film on the graphene layer to form a polymer film-graphene layer-carrier laminate;

removing the carrier substrate from the polymer film-graphene layer-carrier laminate to form a polymer film-graphene layer laminate;

attaching a mesh to the polymer film-graphene layer laminate to form a polymer film-graphene layer-mesh laminate, the mesh comprising metallic, semiconductor or ceramic mesh grid with micron-sized openings in the mesh;

removing the polymer film from the polymer film-graphene layer-mesh laminate to form a graphene layer-mesh laminate; and depositing a photosensitive film on the graphene layer-mesh laminate to form a graphene layer-mesh-photosensitive film laminate.

2. The method of claim 1, wherein the graphene layer has a first surface contacting the mesh and the photosensitive film, and a second surface opposite to the first surface, the second surface being a free surface.

3. The method of claim 1, wherein the depositing of the graphene layer is through chemical-vapor-deposition.

4. The method of claim 1, wherein the removing of the carrier substrate from the polymer film-graphene layer-carrier laminate comprises:

etching of the carrier substrate or peeling off of the carrier substrate utilizing a mechanical force.

5. The method of claim 1, wherein the applying of the polymer film on the graphene layer is through spin coating.

6. The method of claim 1, wherein the removing of the polymer film from the polymer film-graphene layer-mesh laminate comprises etching the polymer film utilizing acetone.

7. The method of claim 1, wherein the attaching of the mesh to the polymer film-graphene layer laminate to form a polymer film-graphene layer-mesh laminate is through directly contacting the mesh with a surface of the graphene layer opposite to a surface in contact with the polymer film.

8. The method of claim 1, further comprising prior to the depositing of the photosensitive film on the graphene layer-mesh laminate:

forming an other polymer film-graphene layer laminate by repeating acts from the depositing of a graphene layer on a carrier substrate to the removing of the carrier substrate from the polymer film-graphene layer-carrier laminate;

attaching the other polymer film-graphene layer laminate on the graphene layer-mesh laminate to form an other polymer film-graphene layer-mesh laminate; and removing the polymer film from the other polymer film-graphene layer-mesh laminate to form an other graphene layer-mesh laminate.

9. The method of claim 1, further comprising depositing a sealing layer on the photosensitive film to form a graphene layer-mesh-photosensitive film-sealing layer laminate.

10. The method of claim 9, wherein the sealing layer has a first surface in contact with the photosensitive film, and a second surface opposite to the first surface, the second surface being a free surface.

* * * * *